US005860562A

United States Patent [19]

Fedak

[11] Patent Number: 5,860,562

[45] Date of Patent: Jan. 19, 1999

[54] PACKAGE DISPENSER

[76] Inventor: Charles J. Fedak, 13 Bucky La., Vernon, N.J. 07462

[21] Appl. No.: 436,844

[22] Filed: May 8, 1995

[51] Int. Cl.[6] ..... B65G 59/00

[52] U.S. Cl. ..... 221/124; 221/132

[58] Field of Search ..... 221/127, 123, 221/124, 268, 272, 131, 132

[56] References Cited

U.S. PATENT DOCUMENTS

| | | | |
|---|---|---|---|
| 2,013,901 | 9/1935 | Shankland | 221/132 |
| 3,002,653 | 10/1961 | Danzinger | 221/124 |
| 3,343,553 | 9/1967 | Whitmore | 221/124 |

*Primary Examiner*—Kenneth Noland

[57] ABSTRACT

A dispenser is provided for dispensing packaged goods such as tea bags, coffee and the like. The dispenser has a base having a horizontal platform portion and a plurality of vertical, upstanding walls wherein each three walls form a vertical compartment having an open side, in which the tea bags are stacked one on top of other and are visible through an open side of the compartment. A slidable tray is positioned at the bottom of each compartment and is adapted to be pulled outwardly when dispensing the tea bag, and inwardly to its initial position after removing the tea bag. A cover member having transparent sidewalls can be placed above the base and locked onto the platform portion.

8 Claims, 2 Drawing Sheets

PACKAGE DISPENSER

FIELD OF THE INVENTION

This invention relates to dispensers in general, and it particularly relates to dispensers for packaged articles such as tea bags, coffee and the like. In one specific aspect, the present invention is directed to dispensers for home use for dispensing tea bags, coffee and other packaged goods.

BACKGROUND OF THE INVENTION

A variety of dispensers have been widely used over the years for dispensing different size containers and packaged goods. In general, most of these dispensers have been designed for automatically dispensing the packages by activating a push button or by pulling or pushing a lever. The packaged articles themselves are usually stacked in one or more chutes or compartments which are rotatably mounted on a rotatable tray. Because of their sizes, however, such dispensers have been mostly limited in their use to industrial institutions such as supermarkets, commercial buildings and other similar locations.

Numerous patents have described the different packaging and vending machines which have been available in the art. For example, a gum vending machine was described early in U.S. Pat. No. 1,121,804, issued Dec. 22, 1914, and a vending apparatus has been described in U.S. Pat. No. 2,208,298 issued Jul. 16, 1940. The apparatus described therein dispenses small packages of nuts or confections.

U.S. Pat. No. 3,161,320 issued Dec. 15, 1964 describes a dispenser which stores bread and dispenses individual slices therefrom.

U.S. Pat. No. 3,782,594 issued Jan. 1, 1974 describes a chip holder and dispenser. The chips are stacked in vertical chutes and a mechanical chip dispensing means is employed to eject the chips from the chutes one at a time.

A more recent patent, i.e., U.S. Pat. No. 5,065,897 issued Nov. 19, 1991 describes a dispenser for stacked articles such as cigarette box. The dispenser includes two levels of individual dispensing modules, each module containing vertically stacked articles. A dispensing mechanism selectively withdraws an article from one stack holder and conveys the article to an open center from where it is removed. The individual modules are arranged in two levels, and when the open center of the top and bottom modules are aligned, the article dispensed from the top level module falls through the open center of the corresponding bottom level modules.

U.S. Pat. No. 5,261,564 issued Nov. 16, 1993 describes a drum-type vending machine for vending small articles such as snack-size candy. The articles are held in a plurality of rotating bins, and a dispensing mechanism in the form of a coin slide and a vertical chute permit the lower-most article to be dispensed from the bin which has been rotated to its dispensing position.

Notwithstanding the variety of available dispensers and vending machines, so, far as it is known there is no simple and economical dispenser for dispensing small packages such as tea bags and like articles, for use in various homes and restaurants.

Accordingly, it is a general object of this invention to provide such dispensers which are relatively small, compact and easy to use in homes and restaurants, and thus constitutes another staple home kitchen product.

It is another object of this invention to provide such dispensers which are relatively small, compact and easy to use in homes and restaurants, and thus can constitute another staple home kitchen product.

The foregoing and other objects of this invention will be more fully comprehended from the following detailed description of the drawings.

SUMMARY OF THE INVENTION

In accordance with this invention, there is provided a dispenser for dispensing small packages such as tea bags, coffee and similar articles, and which because of its relatively small size and convenience of use, it is particularly useful in home and in various restaurants.

The dispenser comprises a base member having a horizontal platform and a plurality of vertically upstanding walls, with each three walls forming a vertical compartment having one open side, and wherein the tea bags are stacked one on top of the other. A slidable tray is positioned at the bottom of each of said compartments, each tray having a flange which is adapted to be grasped between the thumb and forefinger of the user to slidably pull the tray outwardly when dispensing the tea bag and pushed inwardly to return the tray to its initial position after the tea bag is removed. The dispenser also has a cover member having a top cover and sidewall descending therefrom. The cover member is adapted to be placed on the base and locked into position relative to the horizontal platform.

DETAILED DESCRIPTION OF THE DRAWINGS

In the drawings, wherein like reference numerals are employed to designate like parts:

DETAILED DESCRIPTION OF THE INVENTION

Figure 1:
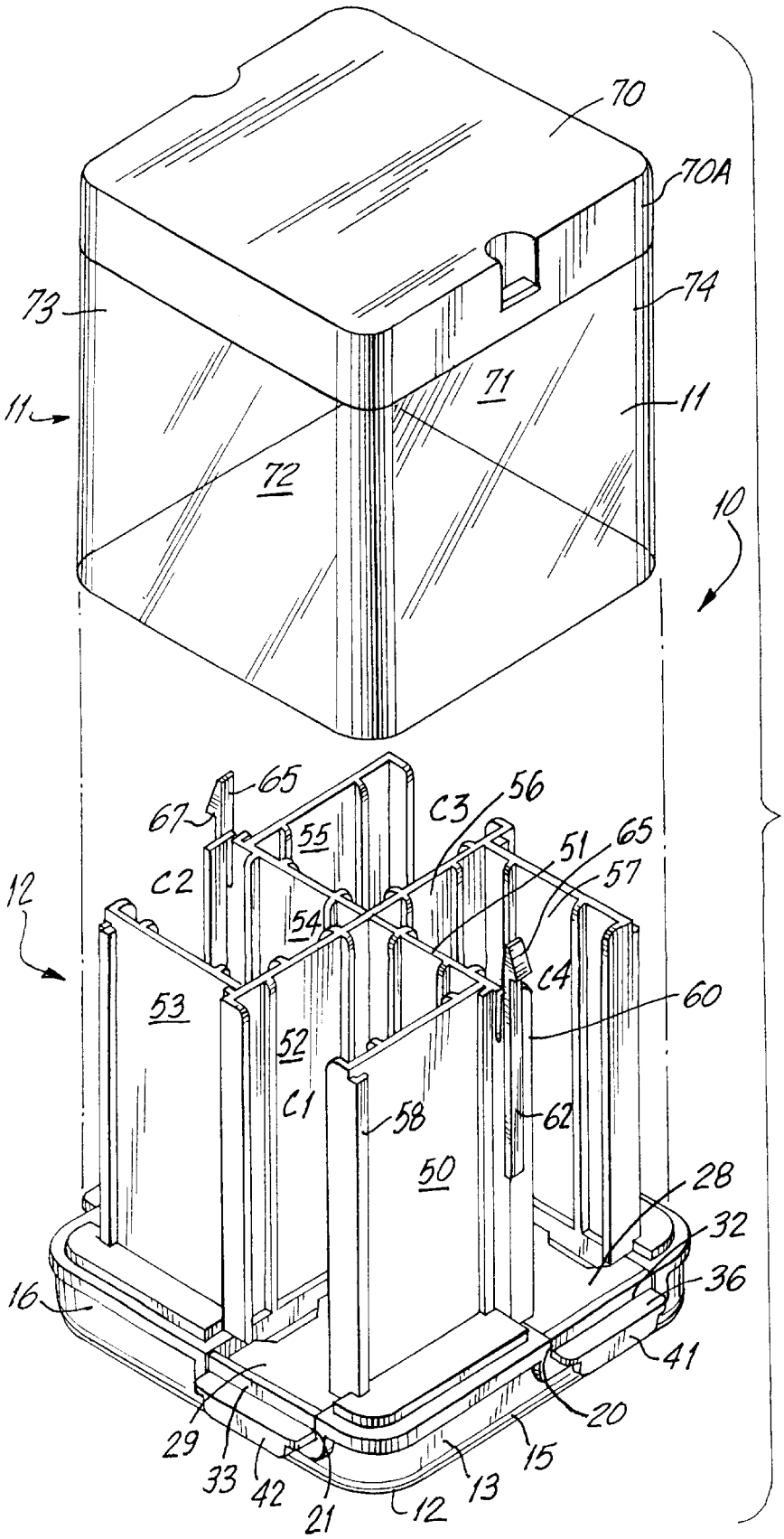
FIG. 1 is a perspective exploded view of the dispenser of the present invention.
Figure 2:
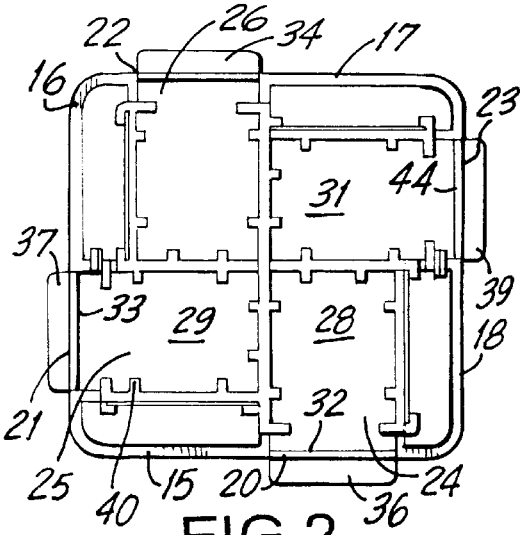
FIG. 2 is a top view of the base member of the dispenser shown in FIG. 1.
Figure 3:
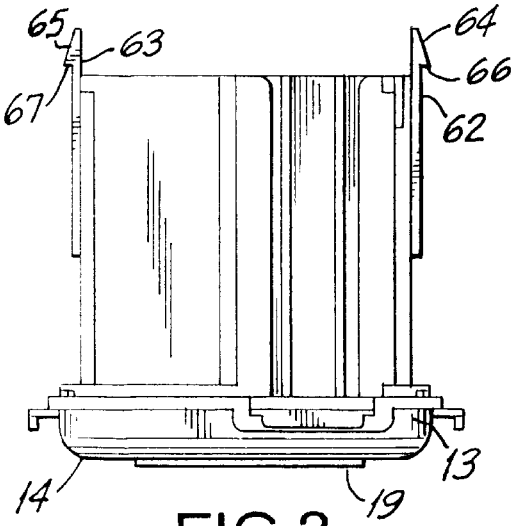
FIG. 3 is a front elevational view of the base member.
Figure 5:
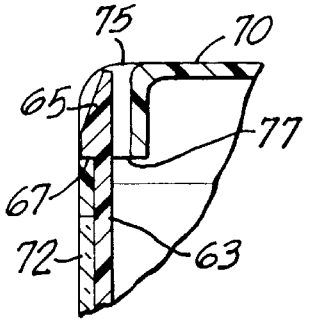
FIG. 5 is an enlarged cross-sectional view taken along the line 5—5 in Figure.

Referring to the drawings, there is shown in FIG. 1, a dispenser generally designated as 10 comprising a cover member 11 and a base member 12. The base member 12 has a raised bottom horizontal platform 13 having a flat bottom portion 14 and four upstanding walls 15, 16, 17 and 18 as shown in FIGS. 2 and 3. The raised platform 13 is rotatably mounted on a disk-like turntable 19 by means of a screw or the like, within a circular depression located in the bottom wall 14, so that the dispenser is freely rotatable on the turntable. Each of the four walls 15, 16, 17, 18 has an elongated generally U-shaped depression 20, 21, 22, 23, respectively, and a slidable tray member 24, 25, 26, 27 is fitted to slide through each of the corresponding U-shaped depression. Each tray member 24, 25, 26, 27 has a relatively flat surface 28, 29, 30, 31, and a raised front portion 32, 33, 34, 35 which is of the same width as its corresponding tray, and a pull handle portion 36, 37, 28, 39 having an integral downwardly extending flange portion 41, 42, 43, 44. Each of the flange portions 41, 42, 43, 44 is adapted to be grasped between the thumb and forefinger of the user to pull the tray out or push it in the U-shaped depression.

As is further shown in the drawings, particularly in FIG. 1, the dispenser comprises four vertically disposed compartments C1, C2, C3, C4 (magazines or chutes) formed by the vertical upstanding walls 50, 51, 52, 43, 54, 55, 56, 57, with each three walls defining one compartment. Thus, compartment C1 is defined by the vertical walls 50, 51, 52; compartment C2 is defined by the vertical walls 52, 53, 54; compartment C3 is defined by the vertical walls 54, 55, 56 and compartment C4 is defined by the vertical walls 56, 57, 51. At is can be seen from FIGS. 1 and 4, each compartment or chute is open on one side through which the packaged articles are visible. Interiorly, the upstanding vertical walls 50–57 have elongated protrusion guides 40, spanning substantially the height of the wall, and protruding into each compartment. In the embodiment described herein, there are six such elongated protrusion guides in each compartment with two protrusion guides on each sidewall and two on the back of each compartment.

Each of the walls 50–57 has an upwardly projecting flange portion for retaining the packaged articles. The walls 50–57 each has an inwardly projecting flange member which defines a vertical channel spanning the length (height) if the wall. A cardboard or a decal may be inserted between these channels covering the exterior side of the vertical wall. The cardboard may bear pictures or words describing the packaged article.

As shown in FIGS. 1 and 3, the dispenser also comprises flexible spring press locks 62, 63 each terminating, respectively, in the integral head portion 64, 65, with each head having a look-like flange 66, 67. The cam-shaped faces of the head portions 64, 65 bias the spring arms 62, 63 inwardly when the cover member 11 is placed on the base member (see FIG. 4). The cover member 11 comprises a top cover portion 70 which is preferably opaque and formed of a suitable plastic material. The cover member 11 also comprises four vertically descending side walls 71, 72, 73, 74 which are preferably of transparent plastic material for viewing the packaged articles in the different compartments.

Figure 4:
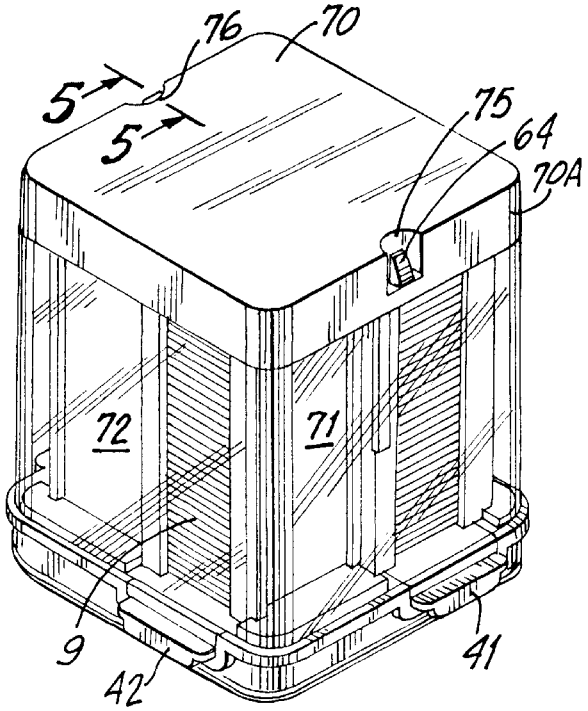
FIG. 4 is a perspective view of the dispenser of the present invention containing packaged tea bags.

The top cover portion 70 comprises a peripheral edge portion 70A which is secured to the sidewalls 71, 72, 73, 74 by an adhesive or other suitable means. As shown in FIGS. 1 and 4, the top cover portion 70 contains two indented portions 75, 76 having openings 77, 78 disposed midway on the sidewalls 71, 73. Thus, when the cover member 11 is placed.on the base member 12, in order to close and lock the cover member 11 in position, the closure heads 64, 65 are inserted through the openings 77, 78 and the spring arms 62, 63 urge the closure heads outwardly thus locking the cover member 11 onto the base member 12. In such locked position, the head flanges 66, 67 lock on the outer edges of the openings 77, 78 (see FIG. 4). In order to unlock the cover member 11 and remove it from the base member, the closure heads 64, 65 are pushed inwardly while simultaneously lifting the cover member.

In use, the cover member 11 is first removed and each compartment is loaded with the individual package such as tea bags, with each tea bag stacked on top of the other. A typical dispenser for use in the homes can be stacked with approximately 30 or more tea bags in each compartment, which can be maintained fresh for a long time. In order to dispense a tea bag, the dispenser is rotated so that the open side of the desired compartment such as, for example, compartment C1, is visible to the user. In this position, the flange portion 40 of the handle portion 36 is pulled outwardly thereby permitting the lower-most tea bag on the tray 24 to be dispensed from the compartment. After removal of the dispensed tea bag, the flange portion 40 is pushed in to return the tray 24 to its initial position.

The component parts of the dispenser are generally fabricated from suitable plastic materials. A typical dispenser for home use may be approximately 8 inches in height, 6 inches wide and 6 inches deep.

While the dispenser of the present invention has heretofore been described with certain degrees of particularity, it is apparent to those skilled in the art that several modifications may be made in its construction which are obvious from the foregoing detailed description, and hence are within the scope of this invention.

What is claimed is:

1. A dispenser adapted to dispense relatively flat packages, said dispenser comprising:

(a) a base member having a horizontally disposed platform portion having a bottom wall and a circular depression therein, and a disk-like turntable rotatably mounted in said depression, and a plurality of vertical, substantially parallel walls upstanding from said platform and forming a plurality of vertical compartments, each compartment adapted to hold a plurality of said packages, one stacked on the other;

(b) a plurality of slidable trays, each tray being positioned at the bottom of said compartment for retaining the lower-most package, each of said trays being slidable outwardly from its compartment when dispensing a package from said compartment, and inwardly after removing said package, and (c) a cover member to cover said base member, said cover member having a top cover and sidewalls descending therefrom.

2. A dispenser as in claim 1 wherein said base member is formed as a single unitary injection-molded member.

3. A dispenser as in claim 1 wherein each of said compartments is formed by three of said vertical walls and wherein each of said compartment has an open side for viewing the packages in said compartments.

4. A dispenser as in claim 2 wherein each of said compartments is formed by three of said vertical walls and wherein each of said compartment has an open side for viewing the packages in said compartments.

5. A dispenser as in claim 1 containing four vertically disposed compartments wherein said platform portion and each of said compartments is substantially square in shape.

6. A dispenser as in claim 2 containing four vertically disposed compartments wherein said platform portion and each of said compartments is substantially square in shape.

7. A dispenser as in claim 3 containing four vertically disposed compartments wherein said platform portion and each of said compartments is substantially square in shape.

8. A dispenser as in claim 4 containing four vertically disposed compartments wherein said platform portion and each of said compartments is substantially square in shape.

* * * * *